United States Patent [19]

Wunderlich

[11] 4,069,140

[45] Jan. 17, 1978

[54] REMOVING CONTAMINANT FROM HYDROCARBONACEOUS FLUID

[75] Inventor: Donald K. Wunderlich, Richardson, Tex.

[73] Assignee: Atlantic Richfield Company, Los Angeles, Calif.

[21] Appl. No.: 578,648

[22] Filed: May 19, 1975

Related U.S. Application Data

[63] Continuation-in-part of Ser. No. 548,525, Feb. 10, 1975, abandoned.

[51] Int. Cl.[2] ..... C10G 29/04

[52] U.S. Cl. ..... 208/251 H; 208/253

[58] Field of Search ..... 208/253, 251 H; 252/466 J, 427

[56] References Cited

U.S. PATENT DOCUMENTS

| | | | |
|---|---|---|---|
| 2,697,066 | 12/1954 | Sieg | 252/465 |
| 3,407,149 | 10/1968 | Taylor et al. | 252/466 J |
| 3,429,660 | 2/1969 | Keith et al. | 252/463 |
| 3,530,066 | 9/1970 | Kuwata et al. | 208/254 H |
| 3,558,508 | 1/1971 | Keith et al. | 252/463 |
| 3,817,855 | 6/1974 | Smith et al. | 208/253 |
| 3,819,509 | 6/1974 | Wolk et al. | 208/251 H |
| 3,870,657 | 3/1975 | Pitzer | 252/466 J |
| 3,896,049 | 7/1975 | Dworak | 252/466 J |
| 3,933,624 | 1/1976 | Myers | 208/251 H |
| 3,947,347 | 3/1976 | Mitchell | 208/251 H |
| 3,954,603 | 5/1976 | Curtin | 208/251 H |

*Primary Examiner*—Delbert E. Gantz
*Assistant Examiner*—James W. Hellwege
*Attorney, Agent, or Firm*—M. David Folzenlogen

[57] ABSTRACT

A method of removing a contaminant, such as arsenic or selenium, from a synthetic hydrocarbonaceous fluid characterized by contacting the hydrocarbonaceous fluid with a plurality of particles of a specially treated contaminant-removing material that will remove the contaminant, under a reducing atmosphere, such as hydrogen, at an elevated temperature. Also disclosed are methods of preparing the contaminant-removing material, which preferably comprises a high surface area carrier material having one or both of a high pore volume of at least 0.8 cubic centimeters per gram with a major portion of the pore volume having a mean effective pore radius greater than 100 Angstroms (° A) and feeder pores having radii greater than 1,000° A for fluid flow therethrough, and carrying a contaminant-removing (active) material at least adjacent the pores. In one embodiment, the active and carrier materials are co-precipitated for improved results; whereas in another embodiment the active material is distributed through the carrier material by impregnation and calcination.

12 Claims, No Drawings

REMOVING CONTAMINANT FROM HYDROCARBONACEOUS FLUID

CROSS REFERENCES TO RELATED APPLICATIONS

This is a continuation-in-part of U.S. application Ser. No. 548,525, filed Feb. 10, 1975, now abandoned.

BACKGROUND OF THE INVENTION

1. Field of the Invention

This invention relates to a method of removing impurities or contaminants; such as, arsenic or selenium; from hydrocarbonaceous fluids, such as synthetic crude oil or fractions thereof.

2. Description of the Prior Art

There has been a resurgence of interest in sources of energy that were formerly considered not to be competitive. These sources of energy include shale oil, liquefied and/or gasified coal, the bitumen from tar sands, and the like. Frequently, these fluids are combined under generic terms like "synthetic hydrocarbonaceous fluids", "synthetic crude oil", or "synthetic oil fractions". Some of these synthetic hydrocarbonaceous fluids contain contaminants that could reduce the activity of certain catalysts that are used in hydrogenation and other processes to which such hydrocarbonaceous fluids may be subjected before used as sources of energy. Even if such hydrocarbonaceous fluids are employed directly as fuels, the removal of such contaminants may be desirable for environmental purposes. Consequently, it could sometimes be preferable that the contaminants be removed, or lowered in concentration.

The prior art includes methods of removing arsenic from hydrocarbon charge stocks, such as described in U.S. Pat. No. 2,778,779. Such methods have included using iron, nickel and cobalt oxides to remove arsenic from streams of naturally occurring crude oil fractions; for example, naphtha or straight run gasoline. In that process, the oxides were employed at a low temperature, such as from room temperature to about 200° F, without regard to the atmosphere under which the reaction takes place and with substantial amounts of water, the oxide acting as an oxidizing agent and oxidizing the arsenic to a water soluble arsenic oxide. In this way, the arsenic oxide is dissolved in the water and removed from the naturally occurring crude oil or oil fraction.

Also, as disclosed in U.S. Pat. No. 2,781,297, arsenic has been removed from similarly naturally occurring crude oils by contacting them with a metallic salt of a strong acid at low temperature, such as room temperature, without regard to the atmosphere under which the contacting takes place. In this particular process, it was taught that oxides do not work for removing arsenic.

One of the most pertinent patents of which we are aware is U.S. Pat. No. 3,496,099, which describes the catalytic hydrogenation of hydrocarbons to effect the precipitation of an insoluble iron salt of the iron porphyrin within a hydrogenating catalyst that increases in concentration longitudinally and concurrently with the flow of the feed; the feed being naturally occurring hydrocarbons.

SUMMARY OF THE INVENTION

Accordingly, it is an object of this invention to provide a method of removing a contaminant of at least one of arsenic and selenium from a feed stream of synthetic hydrocarbonaceous fluid that does not require the use of aqueous, or hydrophilic, solutions, and alleviates one or more of the difficulties of the prior art.

More specifically, it is an object of this invention to provide a method of removing the contaminant from the feed stream that accomplishes the foregoing object and provides stable contaminant-removing material that is active, not only in the surface portion, but throughout a substantial portion of the interiors of the contaminant-removing particles.

These and other objects will become apparent from the descriptive matter hereinafter.

It has now been discovered that at least one of the contaminants of arsenic and selenium can be removed from a hydrocarbonaceous fluid (gas and/or liquid) feed that is not naturally occurring (that is, is not a naturally occurring crudie oil or a fraction derived therefrom) but which is obtained from normally solid coal, oil shale, or tar (including tar sands). The feed for this invention can, therefore, be a synthetic crude oil or fraction derived therefrom. The nonnaturally occurring hydrocarbonaceous fluid is contacted with an active material selected from the group consisting of iron, cobalt, nickel, oxides of one or more of those metals, sulfides of one or more of those metals, and combinations of two or more of said metals, oxides and/or sulfides.

In accordance with one embodiment of this invention, the following multi-step process removes a contaminant of at least one of arsenic and selenium from a hydrocarbonaceous fluid feed stream. First, there is formed a plurality of particles of a contaminant-removing material that includes a solid, high surface area carrier material having one and preferably both of unusually high pore volume of at least 0.8 cubic centimeters per gram with a major portion of the pore volume having a mean effective pore radius greater than 100 A and feeder pores having radii greater than 1,000 A running through the carrier material for allowing a hydrocarbonaceous fluid to flow therethrough, and carrying an active material dispersed at least about the pores for effecting removal of the contaminant from the hydrocarbonaceous fluid. Suitable carriers include silica, alumina, magnesia, zirconia, thoria, zinc oxide, chromium oxide, silicon carbide, naturally occurring carriers; such as clays including special clay like fuller's earth, kieselguhr, pumice, bauxite and the like, and combinations of two or more thereof whether naturally occurring or prepared. The carrier materials are specially treated, however, to have the at least one of high pore volume and feeder pores. Second, the hydrocarbonaceous fluid having the contaminant therein is contacted with the contaminant-removing material in a hydrogen atmosphere. The pressure can be ambient or superatmospheric, for example, at least 500 pounds per square inch (psi), and preferably 1,000 psi. The temperature is elevated, for example, at least 300° F. The process is carried out in the substantial absence of water so that the contaminant is deposited in the particles of the contaminant-removing material. By "substantially no water" or "substantial absence of water" is meant less than 1.0, preferably, less than 0.1, percent by weight of water in the hydrocarbonaceous fluid to be treated. In this manner, the impurities are taken up by the material itself in a substantially water insoluble form.

The manner in which the contaminants are removed from they hydrocarbonaceous fluid is not entirely clear. It is possible that the contaminant-removing material is involved as a catalyst in effecting a decomposition of organic compounds of the contaminants, such as organo-arsenic compounds. In any event, solids, including the contaminant, such as arsenic, are deposited in the interstices, or voids, intermediate the particles. Also, analysis of the spent material employing iron oxide on a carrier material shows the presence of iron arsenide compounds, such as $FeAs_2$ and FeAs. Consequently, it appears clear that the active material is also involved as a reactant. In addition, it is possible that it acts as an adsorbent, since the arsenic in analyzed beds will show up, not only in the matrices of the structure, but deposited on the surfaces of the particles. Accordingly, the terminology of "effecting deposition of the contaminant within the material" will be employed to connote this apparently complex and inadequately explicable phenomena of the removal of the contaminant. It is sufficient to note, however, that the invention works whether the theories are correct or not and this invention is not to be limited to the consequences of any theory.

In one aspect of this invention, the carrier material is prepared in accordance with published technology to have high pore volume of at least 0.8 cubic centimeters per gram with a major portion of the pore volume having a mean effective pore radius greater than 100 A, feeder pores having radii greater than 1,000 A running therethrough, or both. Thereafter, a soluble salt of the active material is impregnated onto the resulting carrier material at least about the pores and the resulting impregnated carrier is calcined to form the final contaminant-removing material. Preferably, double impregnations with the soluble salt of the active material are employed for better results.

In another aspect of this invention, the contaminant-removing material is formed as a co-precipitated material having the carrier and active materials co-precipitated, the deleterious by-products removed. Solid filler; as delineated hereinafter and including fillers, such as carbon or organic fillers like cellulose fibres, that can be burned out during calcination in an oxidizing atmosphere; are admixed with the comminuted and dried co-precipitated material to form an aqueous slurry that is formed into particles of the desired size and shape. The particles are dried and then calcined in the presence of an oxidizing atmosphere to burn at least a portion of the fillers therefrom and leave the feeder pores, to drive off the deleterious ammonium by-products in specific embodiments, and to convert the metal hydroxides to the corresponding oxides. This treatment achieves the requisite dispersed active and carrier materials having the desired surface area, hardness, and resistance to attrition.

DESCRIPTION OF PREFERRED EMBODIMENTS

To facilitate understanding, the treatment of a stream of a synthetic crude oil or fraction thereof, commonly referred to as syncrude, with the particles of material for removing the contaminant will be described hereinafter.

In the discussion of this invention, reference to arsenic and selenium contaminants is intended to include those contaminants in the form of free or elemental forms as well as those contaminants in any combined form.

According to the method of this invention, a contaminant of one of arsenic, selenium, and combinations thereof, whether in elemental or combined form, are removed from a hydrocarbonaceous fluid feed stream by contacting particles of at least one of the materials set forth hereinbefore. The particles of material should have a surface area of at least 1 square meter per gram, preferably, at least 50 square meters per gram. The active material can be employed by itself or in combination with a conventional support, or carrier material, as delineated hereinbefore.

Suitable commercially available high pore volume carrier materials include the high pore volume aluminas, such as available from Engelhard, Nalco, and American Cyanamid. For example, Engelhard supplies two catalyst carriers having, respectively, surface areas and pore volumes of 258 and 250 square meters per gram ($m^2/gm$) and 0.98 and 1.04 cubic centimeters per gram (cc/gm). The Nalco alumina has a surface area of 360 $m^2/gm$ and a pore volume of 1.5 cc/gm. The American Cyanamid alumina has a surface area of 247 $m^2/gm$ and a pore volume of 0.9 cc/gm.

The contaminant-removing material, whether supported or unsupported, can be in particulate form to enhance intimate contacting of the material with the feed to be treated. In accordance with this invention, the particles of material have at least one and preferably both of large pore volume, as defined better hereinafter, and a large plurality of feeder pores distributed therethrough for allowing the hydrocarbonaceous fluid to flow therethrough and into intimate contact with the active material for more nearly complete removal of the contaminant from the hydrocarbonaceous fluid and more nearly uniform deposition of the contaminant throughout the active material, compared to conventional catalysts and the like. The particle size distribution is not critical, although the greater external surface area the better from a point of view of completeness of contact between the feed and the material. Generally, the material can be in such a form that at least 50 weight percent thereof has a largest cross sectional dimension (that is, the diameter of a particle if it is round or the longest dimension through the center of a particle if it is not round) of no longer than about ½ inch. Preferably, the particle sizes are within the range of 1/32–¼ inch. The particles of material can be in any physical form; including powders, pellets, extrudates, granules, spheres, flakes, cylinders and the like.

Any amount of the material can be employed in the process of this invention, the more material that is present, the better the removal of the contaminant.

As regards the oxides and sulfides of the metals set forth hereinbefore, the ferric, nickelic, cobaltic, ferrous, nickelous, and cobaltous forms can be employed. For exemple, ferric oxides, both $Fe_2O_3$ and $Fe_3O_4$, nickelic oxides, $Ni_2O_3$ and $Ni_3O_4$, and cobaltic oxides, $Co_2O_3$ and $Co_3O_4$ can be employed. Similar reasoning is applicable to the comparable sulfides of the metals and to the ferrous, cobaltous and nickelous forms of the oxides and sulfides.

The feed is treated with the material of this invention such as in a fixed bed reactor; at an elevated temperature. Ordinarily, it is unnecessary to employ a temperature greater than 800° F. The contacting of the hydrocarbonaceous fluid with the material can be effected at a temperature of at least 300° F, and preferably in the range of 400°–850° F. Preferably, the fluid streams are heated upstream of the guard bed by conventionally employed heaters, such as directly fired or indirectly fired heat exchangers. The contacting is effected at a reaction severity sufficient to achieve the desired removal of the contaminant. One variable of reaction severity may be expressed in "space time" or its reciprocal "weight hourly space velocity" (WHSV). For example, such reaction severity can be from about 100 WHSV to about 2 WHSV. The weight hourly space velocity is the rate of flow in weight per hour of hydrocarbonaceous fluid divided by the weight of contaminant-removing material in the bed. At lower WHSV's the breakthrough of a contaminant into the output may be delayed until the bed, or sections, of particles of material, is more nearly completely used up; whereas at high WHSV's, the contaminant may break through before the capacity of the bed is reached. The desired atmosphere can be provided by molecular hydrogen being present as the feed contacts the particulate material in the respective beds. Desirably, there is a hydrogen partial pressure present of at least 500 pounds per square inch gauge (psig), preferably, at least 1,000 psig.

In a typical operation, the materials, in any form, e.g., spheroidal or cylindrical pellets, are employed in one or more chambers, or protector vessels, upstream of the catalyst or the like to be protected. The materials in one chamber are exposed to a predetermined amount of feed to be treated, based on empirical data. The feed is then routed to another chamber containing fresh material for treating the feed.

A particularly advantageous process employs a low temperature chamber in which the fluid feed contacts the particles of material in a low temperature advance bed at about 300°-550° F and contacts a second, and high temperature bed at a temperature of greater than the first bed and in the range of from about 550° F to about 850° F. The materials in accordance with one aspect of this invention are particularly useful in the method of that application.

If desired, instead of merely flowing a predetermined quantity of feed through a bed, then switching, the switching can be made upon "breakthrough" of the contaminant. In determining breakthrough, an effluent stream of the treated feed is monitored to maintain the concentration of the contaminant below a predetermined acceptable level near zero; and breakthrough is indicated by the concentration of contaminant approaching that predetermined acceptable level.

In any event, spent material in the one or more chambers is removed or regenerated in situ after the stream is switched therefrom.

The treatment may be batchwise or in a stream as long as the requisite residence time for contact and removal of the contaminant is afforded. It has been found that for materials comprising a carrier containing about 23 percent by weight of ferric oxide or ferric sulfide, 40 percent or more of the impurities can be removed and retained, based on the weight of both the carrier and the ferric oxide; or about 174 percent based on the weight of the ferric oxide. Other specific percentages are applicable for other materials and can be determined empirically.

There will now be described methods of preparing the contaminant-removing material having at least one of the high pore volume and the feeder pores distributed therethrough.

METHOD OF PREPARING CONTAMINANT-REMOVING MATERIAL

In preparing one of the contaminant-removing materials, a carrier material having the delineated characteristics is prepared. In accordance with a preferred embodiment there is formed an aqueous slurry that includes at least the raw carrier precursor and fillers that include carbon or organic fillers that will burn out during calcination at a temperature of 900° F and higher in an oxidizing atmosphere, as described in detail in U.S. Pat. No. 3,558,508 and briefly later hereinafter. The slurry containing the carrier precursor and the fillers is then formed into particles of the desired size and shape. The particles are dried and calcined in the presence of an oxidizing atmosphere to burn at least a portion of the fillers therefrom and leave feeder pores distributed therethrough for allowing the feed having the contaminant access to the interior of the matrices of the particles of the carrier material; and to achieve the requisite dispersed active and carrier materials, surface area, hardness and resistance to attrition. The active material is incorporated into the particles of the carrier material in oxidized form having high surface area, hardness and resistance to attrition by suitable means. For example, the active material may be co-precipitated with the carrier material such that it will be present, and uniformly distributed throughout the carrier material in the slurry that is formed by admixing the material with the fillers, before the forming of the particles, the drying and calcination. On the other hand, the active material may be impregnated into the carrier material having the delineated characteristics. Each of these methods of forming the material will be discussed in detail hereinafter.

1. Preparation of material by impregnation of active material into carrier material: An economically advantageous method of preparing the contaminant-removing material is by selecting suitable carrier material and impregnating the active material thereinto. The carrier is selected to have at least one, and preferably both, of the following characteristics. The characteristics are: (1) have a pore value of at least 0.8 cc/gm, with a major portion thereof having a mean effective radius greater than 100 A; and (2) have feeder pores, or macropores, greater than 1,000 A in radius, distributed therethrough for allowing the flow of the hydrocarbonaceous fluid and the contaminant throughout the carrier material and the active material when impregnated thereonto.

High pore volume carrier material is already known ansd commercially available. Preparation of high pore volume materia, such as high pore volume catalysts, is described in issued patents, such as U.S. Pat. No. 3,429,660 and U.S. Pat. No. 3,558,508, the details of which are incorporated herein by reference for details omitted herefrom. Accordingly, the descriptive matter on preparing such high pore volume material need not be repeated in detail herein. Briefly, howver, U.S. Pat. No. 3,429,660 describes and claims the method of manufacturing alumina that contains both boehmite and amorphous hydrous alumina by reacting aluminum that is divided so finely that it has a surface area in the range of 75,000-1,000,000 square millimeters per gram, with liquid water in the presence of a water-soluble lower fatty acid such as formic acid. The hydrolysis product including aluminum hydroxide serves as a precursor of the carrier material. The precursor is then dried and calcined to form the final carrier material having the desired high pore volume delineated hereinbefore. U.S. Pat. No. 3,558,508 describes, as its preferred embodiment, counter-current flow of spheroidal droplets of the aqueous slurry of alunina prepared in accordance with U.S. Pat. No. 3,429,660 and gaseous ammonia, through a water immiscible liquid such as carbon tetrachloride, oil or both. Firm spheroidal particles are formed and collected. They are aged in ammonia water, if desired; washed, dried and calcined. The temperature of calcination is preferably in the range of 800°-1,200° F to produce gamma alumina — not catalytically inactive α-alumina. The resulting product is a hard, porous, spheroidal alumina gel.

In order to obtain spheres of improved porosity, additional pore volume, increased surface area and reduced bulk density, it is frequently advantageous to provide a solid filler in the alumina slurry employed in accordance with the desriptive matter of U.S. Pat. No. 3,558,508 outlined hereinbefore.

Various solids can be used as fillers, as noted therein. Fillers having a particle size of about 2–40 microns are particularly desirable, since larger particles may cause the spheres to loose their shape. Examples of typical fillers include alumina, silica, amorphous silica-alumina, crystalline aluminosilicates, carbon, starch and cellulose fibres and mixtures thereof. Carbon and organic fillers such as cellulose fibres may be added and then burned out of the spheres during calcination to improve porosity and even afford an increase in large pores. Suitable cellulose fibres include carboxy methyl cellulose CMC; carboxy ethyl cellulose CEC; carboxy methyl hydroxy ethyl cellulose CMHEC; as well as other similar conventional cellulose fibres. Although up to about 30 percent or more of carbon or other solid fillers, such as cellulose fillers, based upon the weight of the total solids can be added, it was determined that when small amounts of carbon in the vicinity of 1–5 percent are employed along with an alumina filler in amounts of about 20–65 percent, preferably, 30–35 percent, based on total solids, the porosity can be even further improved as compared to alumina alone as a filler. Thus, broadly about 1–30 percent of organic filler (including carbon) and about 15–65 percent of inorganic fillers can be employed.

As implied, the fillers are added to the slurry of the hydrous alumina before the slurry is passed in the spheroidal drop form downwardly through the water immiscible liquid, such as oil containing carbon tetrachloride, or the like.

The spheroidal product when containing the filler material, normally has a pore volume of about 0.6–1.5 cc/gm; whereas if the filler is omitted, the pore volume will often be in the range of 0.3–0.45 cc/gm. It is preferred that sufficient filler be used to give an increase in the large pore volume; that is, pores having radii of at least 100 A of at least about 0.1 cc/gm based on calcined or activated spheres. The calcined or activated type of filler is preferred in this invention, since the hydrates, such as aluminum trihydrates, when used, give rise to more shrinkage during drying and calcination. Moreover, if too much of the hydrates is added, the particles may become very weak and in some instances may shatter. Also, the advantages afforded by the filler can be lessened if more or less fully hydrated metal oxides; for example, α-alumina; are added.

The active material is then impregnated onto the carrier material having at least one and preferably both of the delineated characteristics of the high pore volume and feeder pores. The impregnation is ordinarily effected by thoroughly contacting the carrier material with an aqueous solution of a salt of the active material that will decompose under the calcination condition to form an active material disposed at least about the pores distributed throughout the carrier material. Suitable soluble salts include the nitrates, sulfites and chlorates of the metallic cations or elemental forms of the active material. For best results, it is preferred that a vacuum be pulled on the material and that the aqueous solution of the salt of the active material contacted with the carrier material and subsequently, the excess aqueous solution of the salt of the active material drained from the particles of the carrier material. Air is pulled through the particles to ensure that the water is drained therefrom. Preferably, a second impregnation is carried out after the particles are dried. Following the second impregnation and drying, the impregnated particles are calcined in the oxidizing atmosphere at a temperature greater than 900° F for a time greater than 30 minutes, preferably from 1 to 3 hours. Consequently, the final contaminant-removing material will comprise the active material impregnated into the carrier material at least about the pores therewithin for intimate contact with the hydrocarbonaceous fluid and contaminant in order to effect deposition of the contaminant within the contaminant-removing material, simultaneously removing the contaminants from the hydrocarbonaceous material.

Thereafter, the contaminant-removing material is incorporated into a suitable bed or the like and contacted with the hydrocarbonaceous fluid and contaminant, in the process described hereinbefore and inferred from the example described later hereinafter.

2. Preparation of the contaminant-removing material by co-precipitation: In this invention, the co-precipitated material includes oxidized, uniformly dispersed active and carrier materials so as to be useful, not only as a catalyst, but also as a reactant and an adsorbent to remove the contaminant from the hydrocarbonaceous fluid. The co-precipitated material has a structurally strong solid matrix in which the active material is uniformly distributed throughout the carrier material. Briefly described, the co-precipitated material is prepared as follows. A single aqueous solution is prepared containing uniformly distributed throughout, dissolved water soluble salts XM and YM of an active cation and of a carrier cation, respectively. It is particularly preferred to employ water-soluble salts having anions that form by-products with ammonium cation that decompose with heat to avoid additional filtering and washing to remove the by-products. Consequently, and typically, X is a cation of the active material and is selected from the group consisting of iron and cobalt; Y is a cation of a structurally adequate carrier forming the high surface area material and is aluminum; and M is an anion of a water-soluble salt of X and Y and is selected from the group consisting of nitrate, sulfate, sulfite, phosphate, chlorate, and halide, such as chloride. The single solution of the admixture of the soluble salts having uniform concentration gradients is poured, while stirring, into a stoichiometric excess of an aqueous solution of a basic material, such as a hydroxide or carbonate, that will form insoluble salts with the cations X and Y, such as the aluminum and the iron or cobalt. Sodium and potassium cations can be employed in a basic material, but they form by-products with the chlorides and nitrates that require separate steps of washing and filtering for removal. The carbonates are slightly soluble. Accordingly, it is preferred to employ ammonium hydroxide as the basic solution, since the ammonium by-product can be removed by heating. The insoluble basic salts, such as the hydroxides of iron or cobalt and aluminum are formed as co-precipitates that serve as precursors for the active and carrier materials. The liquid is decanted and the co-precipitates collected by centrifuging. The co-precipitates are dried at a temperature slightly above the boiling point of water. When free of water, the co-precipitates in the preferred embodiment are heated to remove the ammonium by-products; the temperature being raised to approximately 325° F to decompose and remove the ammonium nitrate, or to about 655° F to sublime the ammonium chloride if the latter is employed.

The dried co-precipitate is ground to a fine powder. The powder is mixed with water and with the fillers, such as described hereinbefore to form a thick slurry. If desired, the fillers can be admixed with the soluble salts, but there is some risk that such admixing will interfere with the uniform co-precipitation that is desired for homogenity and that is effected by the specific steps delineated hereinbefore. In any event, the slurry containing the fillers is worked or kneaded to provide the necessary consistency for extrusion. After extrusion of the desired size and shape particles, the material, as in the form of cylinders, is dried to remove the water and then calcined to achieve the necessary solid matrix material having the feeder pores distributed therethrough and having the necessary hardness and surface area. The co-precipitate can be formed into a desired configuration in any other known manner, such as pelletizing, spheroidizing, agglomeration, and the like. The calcination is carried out under the oxidizing atmosphere at the temperatures for the times described hereinbefore.

The relative proportions of the salts are chosen such that the carrier co-precipitate, such as the aluminum hydroxide, is in a proportion of at least 25 percent on a mole basis, in order to give adequate structural strength and integrity, the remainder being essentially the active material serving as the co-precipitate, without consideration of the fillers that burn off. On the other hand, no more than about 95 percent, on a mole basis, of the carrier co-precipitate is employed, since the active material; for example, the ferric hydroxide or cobaltic hydroxide; of the final co-precipitate could require an inordinately large bed of final co-precipitated contaminant-removing material to effect the desired quantitative removal of contaminant or allow an inordinately short time of operation before change out of the material would be required. A useful proportion has been found to have the carrier present in a proportion of about 50 percent on a mole basis of the co-precipitated material in order to obtain high structural integrity, yet have a high enough proportion of the active material that feasibly sized beds of co-precipitated, contaminant-removing material can be employed.

The final co-precipitated material has been examined by x-ray diffraction to try to delineate the character of its lattice. The resulting crystallograms indicate the final form of a 50 mole percent aluminum hydroxide co-precipitate with ferric hydroxide to be $Fe_2Al_2O_6$. In other words, in the co-precipitated material, it is no longer possible to delineate the specific structure of the iron oxide or the aluminum oxide in the matrix. It is believed that this is partly responsible for the unusually good characteristics of maintaining a structural integrity, as well as affording a pore distribution that allows access to all portions of the lattice by the contaminants in the liquid to be treated, particularly in connection with the feeder pores left by burning out of the fillers. When the aluminum and ferric oxides are proportioned as delineated, an examination of specimens with electron microprobe scans after treatment of the synthetic crude to remove the arsenic has shown that while the arsenic is still distributed in a surface layer, the arsenic in this layer is substantially more diffuse; for example, penetrates deeper into the matrix. The material thereby provides a greater capacity, as well as a substantially greater structural integrity.

3. General information: Either before, after, or before and after a feed is contacted with the material above described for contaminant removal, the feed can be treated in other known ways for removal of one or more of the above-identified contaminants. The feed can be pretreated for partial removal of contaminants before the feed is treated in accordance with this invention. After treatment of the feed in accordance with this invention, the feed can be further treated for clean-up removal of the contaminants if desired.

One suitable method that can be practiced in conjunction with this invention is conventional caustic washing. For example, one way to carry out caustic washing is to contact the liquid feed with an aqueous solution of at least one alkali metal hydroxide, such as sodium hydroxide and potassium hydroxide, the hydroxide or combination of hydroxides being present in an amount of from 1 to about 20 weight percent based on the total weight of the aqueous solution. The caustic solution is contacted with the hydrocarbonaceous fluid, or feed, in a solution-feed weight ratio of about 1:1 to about 1:10, the contacting being carried out at a temperature of about 200° F, preferably at least 300° F, with the pressure being maintained sufficient to prevent substantial vaporization of oil and the like; for example, at least about 300 psig. The atmosphere present during contacting with caustic solution can be ambient, although if desired, neutral and/or reducing atmospheres can be employed but are not necessary. After treatment, the aqueous solution is separated from the hydrocarbonaceous fluid by conventional methods, such as employing a settling tank followed by a centrifuge and the like. The hydrocarbonaceous fluid after treating with the caustic solution must be washed with water or other suitable solvent to remove residual caustic solutions and any impurities associated with that solution.

If a contaminant separation process is employed prior to the method of this invention and that process employs water in some manner, substantially all of the water can be removed from the feed before carrying out the method of this invention. Removal of absolutely all of the water is not necessary, since the method of this invention is not deleteriously affected by the presence of water, but neither does the method of this invention require the presence of water to be operable or to act as a processing aid.

The following examples are included to illustrate methods of preparing the contaminant-removing material and a method of removing contaminant from a hydrocarbonaceous fluid, all in accordance with different embodiments and aspects of this invention.

EXAMPLE I

This example illustrates a commercially feasible operation in which a commercially available carrier material having the delineated high pore volume and feeder pores distributed therethrough has the active material impregnated thereinto to provide the finished contaminant-removing material.

The carrier material was prepared as described in U.S. Pat. No. 3,429,660 and U.S. Pat. No. 3,558,508. That material is available commercially under the trade name Engelhard HPV Alumina, sold as a commercial catalyst. The Engelhard HPV Alumina was calcined for one hour at 900° F. About 100 grams of the calcined alumina was placed in a vertical tube and the maximum vacuum operable with a standard vacuum pump pulled thereon. After being thoroughly evacuated, the tube was filled with an aqueous solution comprising 0.5 pound (227 grams) of ferric nitrate having 9 waters of hydration $Fe(NO_3)_3.9H_2O$ in 1,512 milliliters of water. After time for equilibrium to be reached, the aqueous solution was drained from the pellets of alumina. Air was pulled through the pellets for 10 minutes to be sure that all the solution was drained therefrom. The pellets were then dried in a rotary vacuum flask with air pulled over the pellets as they tumbled in the flask. They were heated with two heat lamps for a period of three hours. The dried pellets of alumina were again subjected to impregnation by being again placed in the vertical tube, again having a maximum vacuum pulled thereon and again being submerged in the same aqueous solution of ferric nitrate. The pellets were drained free of the aqueous solution, had air pulled therethrough for 10 minutes, were again placed in the rotary vacuum flask and were dried under the heat lamps with air being pulled therethrough for a period of 3 hours.

The alumina having the double impregnation of ferric nitrate was then calcined at 900° F for one hour to form a high pore volume, feeder pore, iron oxide on alumina catalyst, or contaminant-removing material. Specifically, the resultant contaminant-removing material comprised the alumina carrier having the high pore volume and the feeder pores distributed therethrough and carrying the iron oxide $Fe_2O_3$ disposed into the matrix of the carrier material at least adjacent the pores for intimate contact with a hydrocarbonaceous fluid and contaminant flowed through the pores in accordance with Example III hereinafter.

EXAMPLE II

This example is included to show a method of preparing a co-precipitated, contaminant-removing material having feeder pores distributed therethrough for allowing the flow of the hydrocarbonaceous fluid and contaminant therethrough.

In this example, 70 grams of aluminum nitrate, $Al(NO_3)_3.9H_20$, and 80 grams of iron nitrate, $Fe(NO_3)_3.9H_2O$, is dissolved in 300 milliliters of water. A solution of 160 milliliters of 58 percent ammonium hydroxide and 100 milliliters of water is prepared in a 1,000 milliliter beaker. The solution of the aluminum nitrate and iron nitrate is poured into the ammonium hydroxide solution while stirring constantly. The insoluble hydroxides of iron and aluminum are formed as co-precipitates. The mixture, including the co-precipitates is centrifuged and the liquid decanted. The co-precipitates are dried at 230° F for 8 hours to be free of water. When free of water, the temperature is raised to 325° F for 8 hours to remove the ammonium nitrate. An advantage to using the nitrate salts is that heating removes most of the unwanted by-products without requiring filtering and washing.

The resulting dried co-precipitates are ground in a ball mill for 10 minutes. This forms a fine powder of a size to pass through a 300 standard mesh screen. The fine powder is then admixed with fillers including cellulose fibres having a diameter in the range of 2–40 microns and water until a thick slurry of a desired consistency for extrusion is obtained. About 5 percent of cellulose fibre and about 33 percent alumina filler is employed in the slurry, based on the total weight of solids. The slurry is kneaded and worked to provide the desired consistency for extrusion. The slurry is then extruded through a die having a diameter of ⅛ inch.

The extrusions are dried at 230° F for 4 hours. The dried extrusions are then calcined at 1,050° F for one hour. Consequently, the cellulose fibres are burned out, since the calcination atmosphere is an oxidizing atmosphere. The resulting extrusions have an internal surface of approximately 160 $m^2/gm$ and form a solid matrix that theoretically contains one mole of aluminum oxide per mole of iron oxide. The calcination also incorporates oxygen atoms into the matrix such that the structure $Al_2Fe_2O_6$ delineated hereinbefore is effected with the feeder pores distributed therethrough. The extrusions thus form an embodiment known as the co-precipitated iron and alumina, contaminant-removing material for use in accordance with another aspect of this invention.

EXAMPLE III

This example is included to illustrate comparable results obtained between high mass velocity runs to contact a hydrocarbonaceous fluid having contaminant with both a conventional iron or alumina catalyst and a high pore volume, feeder pore, iron on alumina catalyst in accordance with Example I. As a control against which to evaluate the results, an iron oxide on alumina catalyst containing 20 weight percent iron oxide (among the best conventional ones tested in earlier runs), was employed in this Example. It had a pore volume of 0.31 cc/gm and a surface area of 41 $m^2/gm$.

The high pore volume, feeder pore, iron on alumina contaminant-removing material prepared in accordance with Example I was employed in accordance with an embodiment of this invention as will be described hereinafter. The contaminant-removing material had a high pore volume of 0.72 cc/gm and a surface area of 150 $m^2/gm$ with 23 percent iron oxide on the alumina, effected by impregnation of $Fe_2O_3$, as delineated hereinbefore, at least adjacent the pores of alumina carrier that had a high pore volume of 0.98 cc/gm and a surface area of 258 $m^2/gm$.

The hydrocarbonaceous feed comprised a gas oil having a boiling point range of 400°–950° F and had 45 part per million arsenic therein.

In the runs, the test conditions were designed to be representative of an 8 foot internal diameter guard bed. These conditions are 1.4 pounds per second per square foot (#/sec $ft^2$) of oil feed and a hydrogen flow of 4,700 standard cubic feet per barrel (SCFB).

Specifically, ½ inch reactors were charged, respectively, with 25 grams of the conventional catalyst having twenty percent of iron and the contaminant-removing material of this invention. A 60 micron filter was placed in the reactor effluent line to determine if any solids were present in the reactor effluent in each case. An outline of the test procedure is given in Table I.

TABLE I

1. Hydrostatically test the ½ inch reactor-preheat coil at 4,200 psig.
2. Weigh out 25 grams of the pellets used and load them into the 0.083 inch wall thickness ½ inch O.D.* reactor tube, being sure that they do not get into the preheat coil. Insert an ⅛ I.C.* thermocouple into the bottom of the reactor so the tip just touches the bottom of the bed of extrusions. Record the location of the T.C.* tip relative to the bottom of the reactor. Fill the volume around the T.C. with 8–14 mesh tabular alumina.

3. Leak and pressure check the unit at 2,200 psig.
4. Run a Δp check on the packed bed and record the results.
5. Pressure the unit to 2,000 psig and attain a $H_2$ flow of 58.7 SCF/hr*.
6. While flowing 58.7 SCF/hr of hydrogen, bring the unit to 250° F and begin flowing oil. Line out and run at the following conditions:
   4 lb/hr* oil rate
   700° F
   2,000 psig
   4,700 SCFB $H_2$ (58.7 SCF/hr).
7. Run at these conditions until a breakthrough of arsenic is noted. Take liquid samples three times per day.
8. At shutdown cool the bed to 350° F before cutting the oil flow. Cool on down to 200° F with hydrogen.
9. Purge the bed with nitrogen overnight.
10. Run a reactor Δp check with nitrogen and record results.
11. Pull reactor and cut the bed into three equal sections. Weigh the bed material from each section.

NOTE: Do not cut the oil to the bed while the bed is over 300° F. Use a nitrogen purge if oil cannot be pumped and the bed is still over 300° F.
*O.D. — outside diamter
I.C. — iron constantan
T.C. — thermocouple
SCF/hr — standard cubic feet per hour
lb/hr — pounds per hour
gm/hr — grams per hour —

The run was continued to breakthrough. Breakthrough was noted by the presence of 7 ppm arsenic in the effluent stream from the guard bed.

After the beds had cooled and been purged with nitrogen, pressure drop measurements were taken. The pressure drop measurements indicated that the pressure drops before and after the run were substantially identical, indicating that the respective guard bed materials held up very well. Following breakthrough, the guard bed materials were cut into sections and inspected. Several pellets from the top of the respective beds were mounted and analyzed with an electron microprobe. With respect to the standard material having a 20 percent iron oxide on alumina, the arsenic was concentrated in a layer of only 300 micron depth. In contrast, the arsenic was distributed relatively uniformly across the respective pellets of the high pore volume, feeder pore, iron oxide on alumina contaminant-removing material. The conventional catalyst having 20 percent iron oxide impregnated thereinto had an adsorption capacity of about 9.3 pounds of arsenic per 100 pounds of catalyst charged. The high pore volume, feeder pore, iron oxide on alumina, contaminant-removing material in accordance with this invention had, by way of contrast, 40 pounds of arsenic per 100 pounds of material charged. This represents over a 400 percent greater capacity of a given guard bed before it has to be changed out. This advantage is statistically significant and economically advantageous in commercial operations.

Table II summarizes the results.

TABLE II

HIGH MASS VELOCITY GUARD BED TESTS

| Run Number | Guard Bed Material | Pounds of Arsenic per 100 Pounds of Catalyst Charged |
|---|---|---|
| AR-43 | 20%* $Fe_2O_3$ on $Al_2O_3$ | 9.3 |
| AR-45 | 23% $Fe_2O_3$ on $Al_2O_3$ (hi p.v., feeder pores)* | 40.0 |

*% - percent
hi p.v. - high pore volume as defined hereinbefore

Although the operation of this invention has been described hereinbefore with respect to syncrude, it should be borne in mind that the invention is operable on any hydrocarbonaceous feed that has been obtained by liquefying and/or gasifying each of normally solid coal, normally solid kerogen in oil shale, or the normally solid-like hydrocarbonaceous portions of tar or tar sands.

From the foregoing it can be seen that this invention accomplishes the objects delineated hereinbefore.

Having thus described the invention, it will be understood that such description has been given by way of illustration and example and not by way of limitation, reference for the latter purpose being had to the appended claims.

What is claimed is:

1. A method for removing a contaminant of at least one of arsenic and selenium from a synthetic hydrocarbonaceous fluid comprising:

a. providing a plurality of particles of a contaminant-removing material that is capable of removing said contaminant from said hydrocarbonaceous fluid and effecting deposition of said contaminant within said particles of said contaminant-removing material, said contaminant-removing material including a solid, high surface area carrier material having a pore volume of at least 0.8 cubic centimeters per gram (cc/gm) with a major portion of the pore volume having a mean effective pore radius greater than 100 A and feeder pores having radii greater than 1,000 A running therethrough for allowing said hydrocarbonaceous fluid to flow thereinto, said particles carrying an active material at least adjacent said pores for effecting removal of said contaminant from said hydrocarbonaceous fluid; said carrier material being selected from the group consisting of silica, alumina, magnesia, zirconia, thoria, zinc oxide, chromium oxide, clay, kieselguhr, fuller's earth, pumice, bauxite and combinations thereof; said active material being selected from the group consisting of iron; cobalt; nickel; at least one oxide of the metals of iron, cobalt and nickel; at least one sulfide of said metals; and combinations thereof; and b. contacting said hydrocarbonaceous fluid with said contaminant-removing material in a reducing atmosphere, in the substantial absence of water, and under an elevated temperature and pressure; whereby at least part of said contaminant is removed from said hydrocarbonaceous fluid by way of said particles of contaminant-removing material.

2. The method of claim 1 wherein said contacting is preferably carried out at a temperature of at least about 300° F, and a pressure of at least about 500 psig.

3. The method of claim 1 wherein said particles of contaminant-removing material are prepared by the steps of:

a. forming an aqueous slurry that includes at least a precursor of said carrier material and a filler material that will burn out under the conditions of step d hereof; said precursor being adapted to form said carrier material upon calcination in an oxidizing atmosphere;
b. forming said aqueous slurry into particles of desired size and shape;
c. drying said particles;
d. calcining the dried particles in the presence of an oxidizing atmosphere to burn at least a portion of said filler and to form said carrier material that has high pore volume with said mean effective pore radius and has said feeder pores; and
e. adding said active material to the calcined particles of said carrier material.

4. The method of claim 3 wherein said filler material is selected from the class consisting of carbon, starch, cellulose fibres, and mixtures thereof; and the step of incorporating said active material into said particles of said carrier material in accordance with step e comprises impregnating an aqueous solution of a water-soluble salt of said active material into said carrier material by flowing through the feeder pores distributed therethrough; said salt of said active material being a salt that will convert to an oxidized form of said active material when calcining in an oxidizing atmosphere; and said step e includes the step of calcining said carrier material having said active salt impregnated thereinto in an oxidizing atmosphere to form the final contaminant-removing material.

5. The method of claim 4 wherein said carrier material is gamma alumina; said active material is selected from the class consisting of iron oxide and iron sulfide and said aqueous solution of said soluble iron salt is a solution of ferric nitrate and said aqueous solution of ferric nitrate is impregnated onto said carrier material, dried, a second impregnation carried out and the final impregnated material again dried; and thereafter the resulting finished product is calcined at a temperature in the range of 800–1, 200° F in said oxidizing atmosphere for a period of at least 30 minutes.

6. The method of claim 3 wherein said carrier precursor is a hydroxide of an element that will undergo hydrolysis with water; and said element, in a form so finely divided as to have a surface area in the range of 75,000–1,000,000 square millimeters per gram, is hydrolyzed in water in the presence of a nonoxidizing acid to form a precipitate of said precursor of said carrier material such that, following calcination, said carrier material has said high pore volume; and said active material is incorporated into the particles of said carrier material having said pore volume by impregnating said carrier material with an aqueous solution of a soluble salt of said active material and subsequently drying and calcining the impregnated carrier material to form the final contaminant-removing material.

7. The method of claim 6 wherein said element is aluminum and said carrier material that is formed therefrom is alumina that has a pore volume in a range of 0.8–1.4 cc/gm.

8. The method of claim 7 wherein said active material is selected from the class consisting of iron oxide and iron sulfide and said aqueous solution of said soluble salt is a solution of ferric nitrate and said aqueous solution of ferric nitrate is impregnated onto said carrier material, dried, a second impregnation carried out and the final impregnated material again dried; and the resulting product calcined at a temperatue in the range of 800°–1,200° F in said oxidizing atmosphere for a period of at least 30 minutes to form said contaminant-removing material.

9. The method of claim 6 wherein said filler material is selected from the class consisting of carbon, starch, cellulose fibres, and mixtures thereof.

10. The method of claim 9 wherein said element is aluminum and said carrier material is alumina that has a pore volume in a range of 0.8–1.4 cc/gm.

11. The method of claim 10 wherein said active material is selected from the class consisting of iron oxide and iron sulfide and said aqueous solution of said soluble salt is a solution of ferric nitrate and said aqueous solution of ferric nitrate is impregnated onto said carrier material, dried, a second impregnation carried out and the final impregnated material again dried; and the resulting product calcined at a temperature in the range of 800°–1,200° F in said oxidizing atmosphere for a period of at least 30 minutes to form said contaminant-removing material.

12. The method of claim 1 wherein said particles of contaminant-removing material are prepared by the steps of:
a. coprecipitating together a water-soluble salt of said active material and a precursor of said carrier material, said precursor being adapted to form said carrier material upon calcination in an oxidizing atmosphere, in order to have said active material distributed substanially uniformly throughout said carrier material in the final contaminant-removing material; said co-precipitated active material and precursor are dried and by-products are removed to form a dried co-precipitated material; and said dried co-precipitated material is comminuted to form a uniformly dispersed dried, co-precipitated material; said dried, uniformly dispersed co-precipitated material is incorporated into an aqueous slurry with a filler material that will burn out under the conditions of step d and that is selected from the class consisting of carbon, starch, cellulose fibres, and mixtures thereof;
b. forming said aqueous slurry into particles of desired size and shape;
c. drying said particles; and
d. calcining the dried particles in the presence of an oxidizing atmosphere to burn at least a portion of said filler and to form said particles of contaminant-removing material having said pore volume with said mean effective pore radius and having said feeder pores.

* * * * *

UNITED STATES PATENT OFFICE

CERTIFICATE OF CORRECTION

PATENT NO. : 4,069,140

DATED : January 17, 1978

INVENTOR(S) : Donald K. Wunderlich

It is certified that error appears in the above-identified patent and that said Letters Patent are hereby corrected as shown below:

In Column 3, line 38, "the" should read ---and---.

In Column 12, line 29, "or" should read ---on---.

In Column 15, line 55, after "having said", insert ---high---.

In Column 16, line 18, after "material", insert ---that is formed therefrom---.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*